US005468177A

United States Patent [19]

Kindler et al.

[11] Patent Number: 5,468,177

[45] Date of Patent: Nov. 21, 1995

[54] LAPPING FIXTURE FOR DISK SLIDERS

[75] Inventors: David J. Kindler, Concord; David J. Dupuis, Westminster, both of Mass.

[73] Assignee: Quantum Corporation, Milpitas, Calif.

[21] Appl. No.: 23,274

[22] Filed: Feb. 26, 1993

[51] Int. Cl.[6] ..... B24B 7/07

[52] U.S. Cl. ..... 451/364; 451/278; 269/289 R

[58] Field of Search ..... 51/131.1, 131.3, 51/131.4, 131.5, 132, 281 R, 317, 216 T, 137 R, 123 R, 283 R; 451/285, 287, 288, 289, 290, 274, 299, 28, 41, 36, 364, 278; 269/46, 289 R, 309, 310

[56] References Cited

U.S. PATENT DOCUMENTS 4,165,584 8/1979 Scherrer ..... 51/216 R
4,876,826 10/1989 Denboer ..... 51/216 R
5,023,991 6/1991 Smith .
5,095,613 3/1992 Hussinger et al. .

FOREIGN PATENT DOCUMENTS 63-77651 9/1986 Japan .

*Primary Examiner*—Jack W. Lavinder
*Attorney, Agent, or Firm*—David B. Harrison

[57] ABSTRACT

The invention provides a new method and apparatus for creating smooth and uniform air-bearing surfaces on disk sliders. A lapping fixture includes a compliant pad which allows substantially uniform pressure to be applied between the slider and a lapping surface. Multiple sliders may be lapped simultaneously, with the compliant pad allowing each slider to float substantially independently of the other sliders against the lapping surface. Positioning surfaces are provided on the lapping fixture to position the sliders relative to the lapping surface and to allow a predetermined force to be applied to each slider independent of the force of the lapping fixture against the lapping surface.

4 Claims, 7 Drawing Sheets

FIG. 1
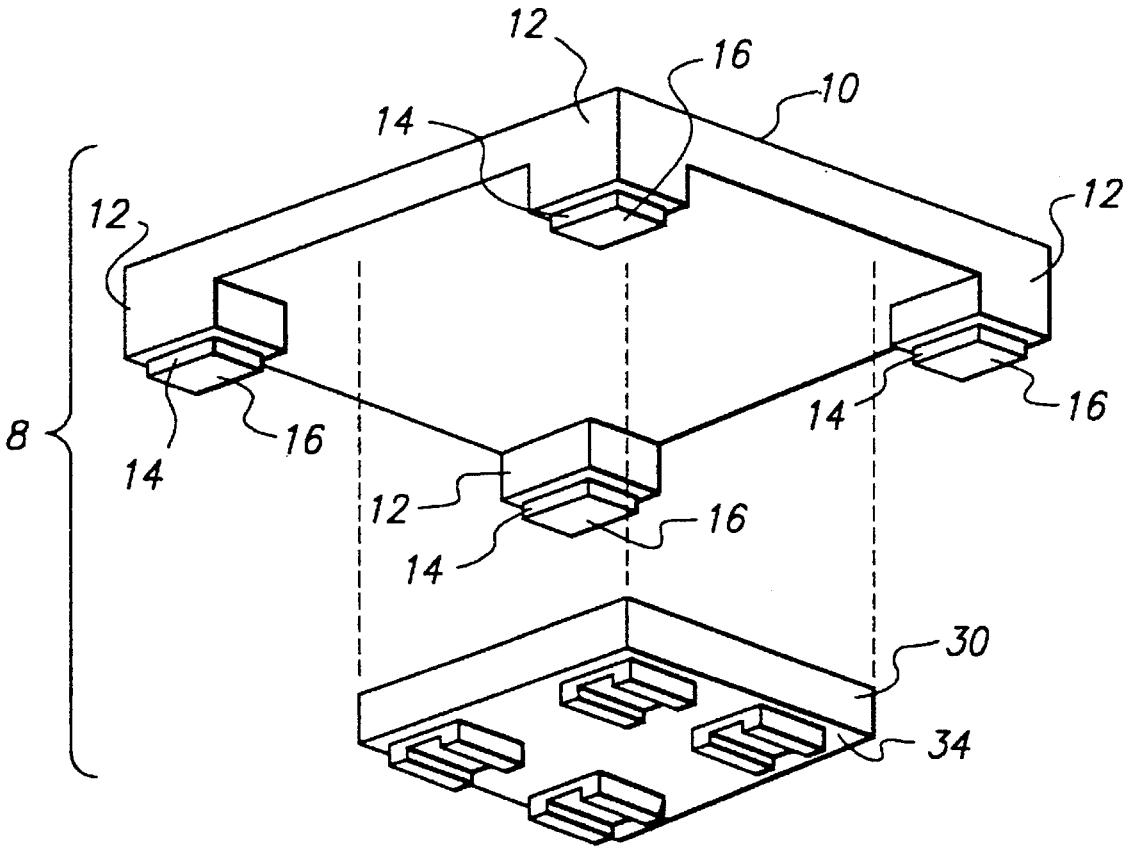
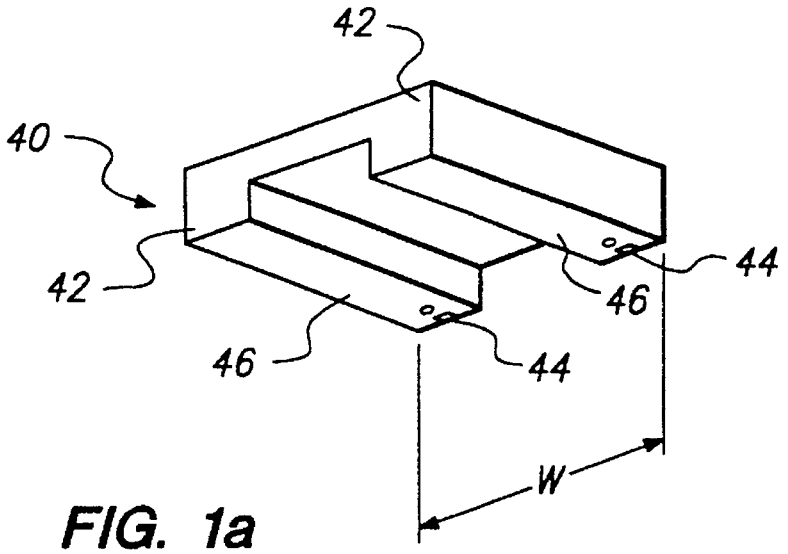
FIG. 1a

LAPPING FIXTURE FOR DISK SLIDERS

FIELD OF THE INVENTION

The present invention relates to an apparatus and a method for lapping the air-bearing surfaces of disk sliders.

BACKGROUND OF THE INVENTION

Hard disk drives are widely used in computer systems to store information. These disk drives have a rigid disk of magnetic material on which binary data may be written and stored for later retrieval. Data is written on the disk by moving a magnetic recording head to a position over the disk where the data is to be stored. The magnetic recording head then generates a magnetic field, which encodes the data into the magnetic material of the disk. Data is read from the disk by similarly positioning the magnetic recording head and then sensing the magnetic field of the disk's magnetic material. The positioning of the magnetic recording head is accomplished by continually spinning the disk while positioning a moveable arm over the surface of the disk. The moveable arm carries the magnetic recording head in a sweeping motion, generally across the radius of the disk. Read and write operations are synchronized with the rotation of the disk to insure that the data is read from and written to the desired location on the disk.

The magnetic recording head is generally encapsulated in a slider, which provides physical support for both the magnetic recording head and the electrical connections between the magnetic recording head and the remainder of the disk drive system. The slider also provides an air-bearing surface which permits the magnetic recording head to "fly" in close proximity to the surface of the spinning disk. As sliders carry the magnetic recording head closer to the disk surface, information may be more closely packed on the disk, increasing the storage capacity of the disk drive system. An important factor in achieving a minimum and predictable flying height of the magnetic recording head over the disk is the surface finish of the slider's air-bearing surface. Sliders having warped or otherwise deformed air-bearing surfaces, or air-bearing surfaces with an improper relation to the surface of the magnetic recording head, impair the performance of disk drive systems.

Sliders, formed from a ceramic wafer, generally have two parallel rails whose bottom surfaces form the air-bearing surface and fly over the spinning disk. The magnetic recording head is mounted within the slider, and extends down through a rail, terminating at the air-bearing surface of the rail. Grinding processes attempt to create a smooth air-bearing surface by removing material from the magnetic recording head and rail surfaces. However, one problem in the production of sliders, referred to as a recession error, or pole tip recession, commonly results from lapping operations where the durability of the magnetic recording head material and that of the slider material differ. When forming the air-bearing surface, the less durable material may be eroded more easily than the other material, resulting in a non-planar air-bearing surface. Various mechanical processes used while producing sliders also induce stresses in the material of individual sliders. These stresses often result in distortions in the slider, such as rails whose air-bearing surfaces are not co-planar due to twisting or cupping of the slider.

In light of the foregoing, it is desirable to have an apparatus for producing very repeatable and very accurate air-bearing surfaces on sliders for disk drives. It is further desirable that this apparatus be inexpensive and simple to use. It is also desirable that this apparatus be capable of finishing the air-bearing surfaces of many sliders simultaneously. It is also desirable that the apparatus be able to correct recession errors in the sliders being finished.

SUMMARY OF THE INVENTION

In a broad sense, the invention relates to a fixture for holding disk sliders against a lapping surface during lapping. The fixture has a compliant pad effective to cause each slider to be pressed independently against the lapping surface. The fixture also has a base with a positioning surface for positioning the compliant pad relative to the lapping surface.

In a narrow sense, the invention relates to a fixture with a compliant pad for holding disk sliders against a lapping surface having a mechanism for adjusting and maintaining the orientation of the sliders relative to a positioning surface on the fixture.

The invention also relates to a process for lapping disk sliders by bringing the sliders, which are spaced apart, into pressing contact relation with a lapping surface.

BRIEF DESCRIPTION OF THE DRAWINGS

FIG. 1 shows an assembly drawing of a lapping fixture according to the invention.

FIG. 1*a* shows an enlarged isometric view of a magnetic recording head slider.

DETAILED DESCRIPTION OF THE PREFERRED EMBODIMENT

Figure 2:
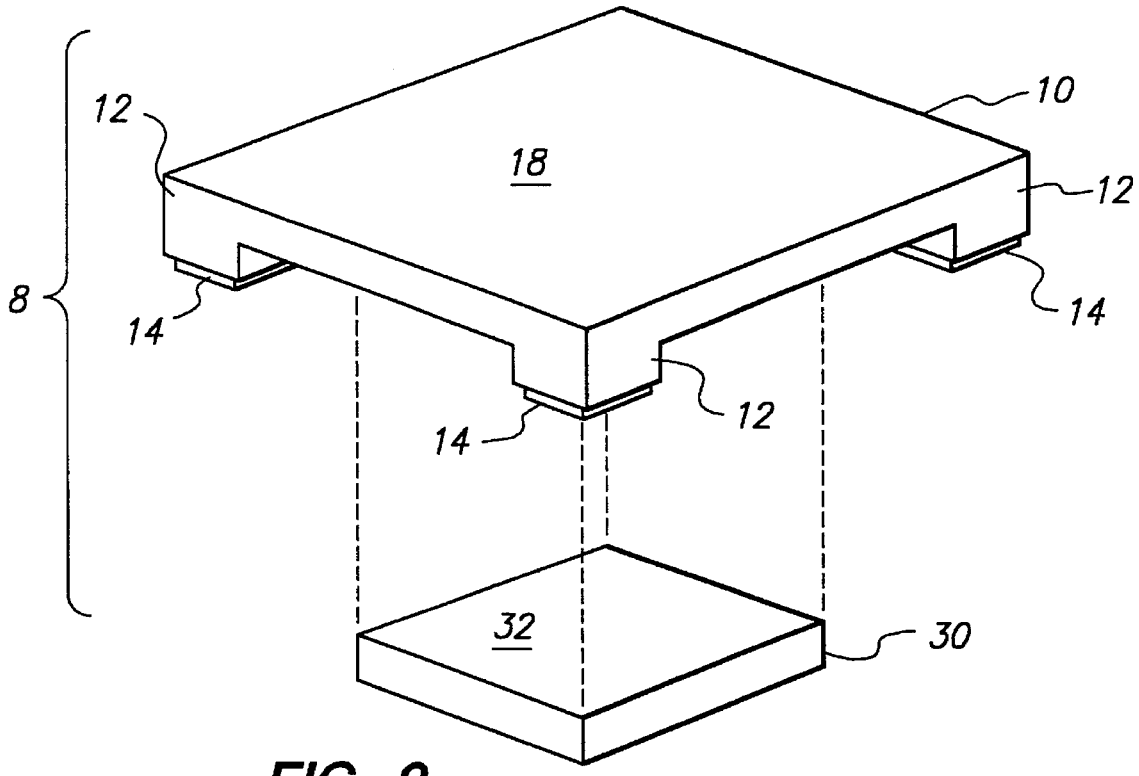
FIG. 2 is another view of the assembly of the lapping fixture of FIG. 1.
Figure 3:
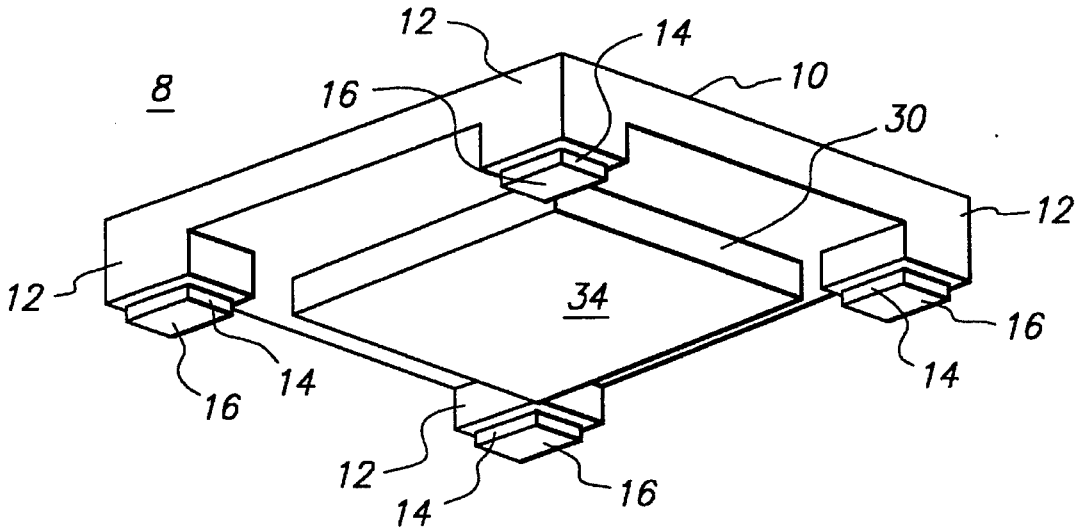
FIG. 3 shows the lapping fixture of FIG. 1 assembled from a base and a compliant pad.

FIGS. 1 through 3 show an embodiment of a lapping fixture 8 according to the principles of the invention. As shown, the lapping fixture 8 is assembled from a base 10 and a compliant pad 30. The base 10 has four supports 12. One support foot 14 is attached to each support 12, with each support foot 14 having a positioning surface 16. The base 10 also has a fixture pressure surface 18, shown most clearly in FIG. 2.

The supports 12 may be integral to, or removable from, the base 10. The purpose of the supports 12 is to provide a stable resting position for the lapping fixture 8 against the lapping surface 52 of a lapping plate 50 (shown in FIG. 5*a*.) This resting position is defined by the positioning surfaces 16 of each support foot 14. Thus, for a planar lapping surface 52, the supports 12 must simply support the positioning surfaces 16 such that the positioning surfaces 16 are coplanar and rigidly positioned relative to the base 8. The support feet 14 attached to each support 12 may be integral, or removable or permanently attached, to the supports 12. Removably attached support feet 14 allow the support feet 14 to be replaced if they are damaged or worn without discarding the supports 12 or the entire base 10. As shown, the base 10 is approximately 2.5 by 2.5 inches square. The base 10 and supports 12 may be made of steel, aluminum, or any other rigid material. In the embodiment shown, the material is steel.

The compliant pad 30 is shown throughout the Figures. The compliant pad 30 has a contact surface 34, seen in FIG. 1, and a pad pressure surface 32, most clearly shown in FIG. 2. The compliant pad 30 is assembled with the base 10 to form the lapping fixture 8. The compliant pad 30 and base 10 are mated such that force which is applied to the fixture pressure surface 18 may be transferred to the pad pressure surface 32 through the structure of the base 10. The compliant pad 30 may be permanently or removable attached to the base 10 by adhesive, a tacky film layer, fasteners, or the like (not shown.) Instead, the compliant pad 30 may be retained in a recess or in simple frictional contact with the base 10. In the embodiment shown, the compliant pad 30 is made of Sorbathone, a viscoelastic solid made by Sorbathone, Inc. and has a durometer hardness of approximately 65–75 on the Shore 00 scale. In addition, the creep rate of the Sorbathone is slow enough that a load applied to the surface of the compliant pad 30 remains constant for a period exceeding five minutes, which is significantly longer than a typical 30 second lapping process. The compliant pad 30 shown is also approximately 2 inches square with a thickness of approximately 0.25 inches. The Sorbathone used for the compliant pad 30 has a tacky outer surface, causing the pad pressure surface 32 to stick to the base 10 without the need for other adhesives or fasteners.

FIG. 1*a* shows an expanded view of a slider 40. The slider 40, formed by machining and grinding operations, has two rails 42. The slider 40 of FIG. 1 is made of aluminum-titanium carbide. Embedded in the rails 42 are magnetic recording heads 44. The magnetic recording heads 44 protrude through the rails 42 and terminate at the outer surface of the rails 42. The outer surface of each rail 52 is known as an air-bearing surface 46 of the slider 40. For simplicity of illustration, the figures show a slider having two rails and rectilinear air-bearing surfaces. However, it will be clear that the principles of the invention are equally applicable to sliders having more rails or more complicated air-bearing surfaces.

Figure 4:
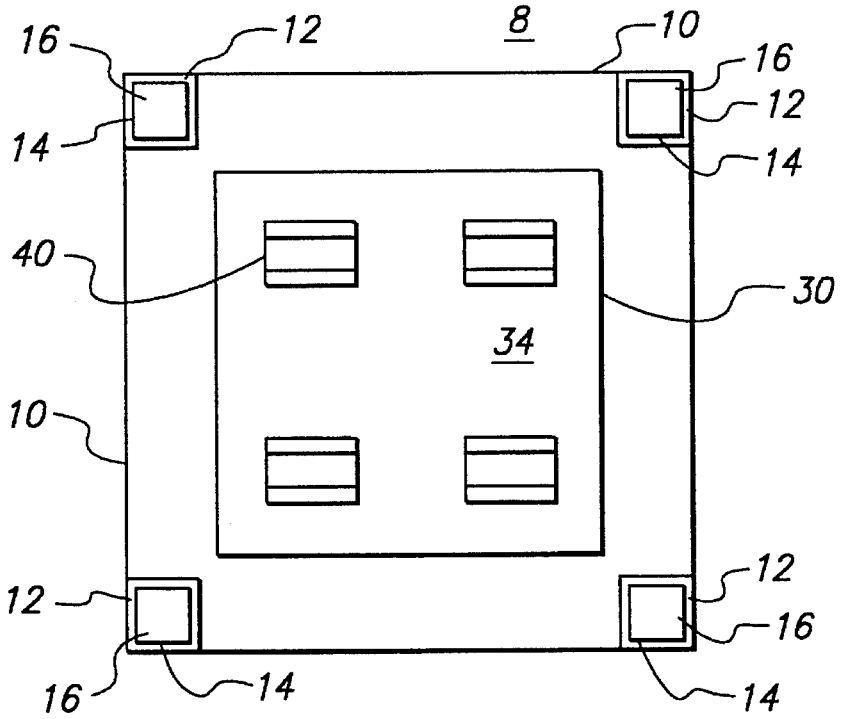
FIG. 4 shows a bottom view of the lapping fixture and magnetic recording head sliders of FIG. 1 mounted on the compliant pad.

FIG. 4 shows a bottom view of the assembled lapping fixture 8 with four sliders 40 attached to the compliant pad 30. Because it is made from Sorbathone, the contact surface 34 of the compliant pad 30 is tacky, and causes the four sliders 40 shown to stick in place. Adhesive or fasteners could be used to hold the sliders 40 in place if the contact surface 34 were not tacky. A coating may also be applied to the compliant pad 30 to prevent the compliant pad 30 from flaking or giving off particulate matter as a result of damage or wear. This matter could foul the lapping process, damaging the air-bearing surfaces 46 of the sliders 40.

As shown, the sliders 40 are spaced apart by approximately the width of one slider 40 or more. The width is noted as 'W' in FIG. 1. While the exact spacing is not critical, it is preferred that the sliders 40 be spaced apart enough so that each may "float" somewhat independently on the contact surface 34 of the compliant pad 30. The sliders 40 shown are approximately 0.080 inches long, 0.063 inches wide, and 0.017 inches thick (the thickness being the dimension normal to the air-bearing surfaces.)

Figure 5A:
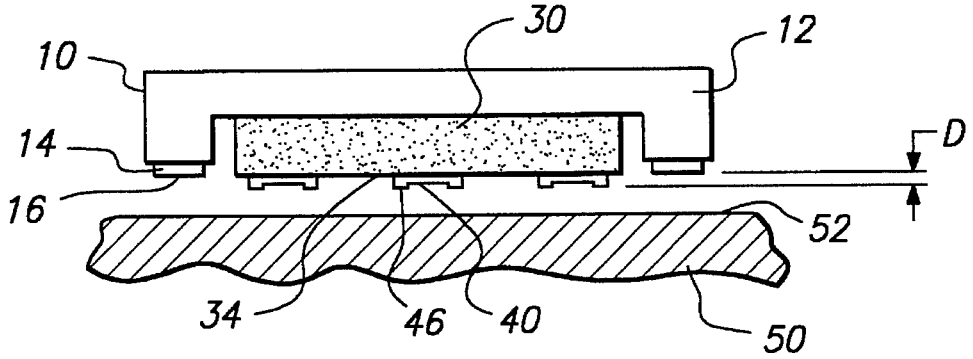
FIG. 5*a* shows an elevation view of the lapping fixture of FIG. 1 and magnetic recording head sliders positioned above a section of a lapping plate.
Figure 5B:
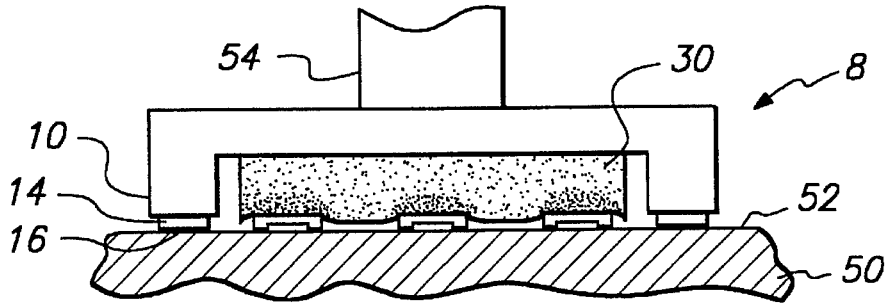
FIG. 5*b* shows an elevation view of the lapping fixture and magnetic recording head sliders positioned against the lapping plate of FIG. 5*a*.

FIGS. 5*a* and 5*b* illustrate the use of the lapping fixture 8. FIG. 5*a* is a plan view of the lapping fixture 8 holding three sliders 40. The thickness of the compliant pad 30 and the dimensions of the supports 12 insure that the air-bearing surfaces 46 of each slider 40 extend below the plane defined by the positioning surfaces 16 of the support feet 14. The air-bearing surfaces 46 extend below the positioning surfaces 16 by a distance 'D', shown in FIG. 5*a*. The lapping fixture 8 and sliders 40 are also shown positioned over the cross-section of a lapping plate 50. The lapping plate 50 has a lapping surface 52 that provides the abrasive action. The lapping surface 52 shown is planar, but other shapes are available.

FIG. 5*b* shows the lapping fixture 8 during the lapping operation. The lapping fixture 8 is positioned against the lapping plate 50 such that the positioning surface 16 of each support foot 14 is resting on the lapping surface 52. Because the sliders 40 had protruded below the positioning surfaces 16, and because the compliant pad 30 is compliant, the sliders 40 are forced into the compliant pad 30. The compliant pad 30 deforms to accommodate each slider 40, each of which is pushed approximately a distance 'D' into the compliant pad 30.

In the embodiments shown, the lapping plate 50 is a disk which rotates to generate the relative motion between the sliders 40 and the lapping surface 52. The sliders 40 are oriented such that the rails 42 are approximately perpendicular to the radius of the lapping plate 50. The lapping surface 52 of the lapping plate 50 is an abrasive surface. The abrasive effect may be achieved by having a liquid slurry which contains a fine abrasive grit riding on the lapping surface 52. In the embodiments shown, very hard particles, such as diamond, are imbedded in the lapping surface 52 of the lapping plate 50, which is made of copper.

Note that the contact surface 34 of the compliant pad 30, as well as the air-bearing surfaces 46 of each slider 40, may not be uniform. This requires that the compliant pad 30 deform somewhat differently for each slider 40. However, because each slider 40 is displaced approximately a distance 'D' into the compliant pad 30, and because of the relatively low durometer of the compliant pad 30, an approximately equal force is applied to each slider 40. As shown, the compliant pad 30 has a durometer of 65–75 on the Shore 00 scale and 'D' is 0.005 to 0.015 inches, resulting in an approximately equal force on each slider 40 as long as the distances 'D' for each slider 40 vary by approximately 10 percent or less. Further, because the sliders 40 are spaced apart and the compliant pad 30 is compliant, each slider 40 may find its own resting plane against the lapping surface 52, and a relatively uniform and equal pressure is applied to each air-bearing surface 46 against the lapping surface 52.

The overall force applied to the lapping fixture 8 against the lapping plate 50 may be generated by the weight of the lapping fixture 8, or by a forcer 54, shown in FIG. 5*b*. The forcer 54 may merely be an object of a predetermined weight, or may instead be a device, optionally including force feedback sensors, for applying a predetermined amount of force against the lapping plate 50. However, the normal force between the lapping fixture 8 and the lapping plate 50 is generally not critical in the embodiment shown. However, it is required that the total normal force against the lapping plate 50 be great enough to bring the positioning surfaces 16 of each of the support feet 14 into contact with the lapping surface 52. Once the support feet 14 have bottomed out on the lapping plate 50, the application of additional force merely causes increased wear on the positioning surface 16 of the support feet 14, and has no significant effect on the sliders 40. The material and size of the support feet 14 are chosen so that the support feet 14 wear more slowly during lapping than the rails 42 of the sliders 40. In the embodiment shown, the support feet 14 are made of the same material as the sliders 40, aluminum-titanium carbide. However, in the embodiments shown, the support feet 14 are made to wear more slowly than the sliders 40 by making the total area of the positioning surfaces 16 exceed the total area of the air-bearing surfaces 46 being lapped by approximately ten times or more. The support feet 14 may also be made from a harder material than the sliders 40 to increase their wear resistance. However, if fragments or particulate matter break off of the harder support foot 14 material, the air-bearing surfaces 46 may incur damage.

The normal force between the air-bearing surfaces 46 of each slider 40 and the lapping surface 52 is determined by the properties of the compliant pad 30 and the displacement distance 'D'. Prior to selecting the displacement distance 'D', the properties of the compliant pad 30 may be found by measuring the force applied to a slider 40 at various displacement distances. Using this characterization, the appropriate value of 'D' is determined that will generate the desired force on each slider 40. In the embodiment shown, the desired force applied to each slider 40 against the lapping surface 52 is approximately 15 to 30 grams. The embodiments shown employ a displacement distance 'D' of approximately 0.005 to 0.015 inches.

While the embodiments shown have four support feet 14, any number and configuration may be used so long as a stable resting plane is provided for the lapping fixture 8. Four are shown, one at each corner of the lapping fixture 8, because of their inherent stability. However, any combination of three or more may generally be used with similar results. The use of a single support foot is also possible where the support foot is centrally located relative to the sliders 40 and where its positioning surface is large enough to provide a stable resting surface. A single support foot could also be used that has concave or hollow features, such as a Y-shape, a crescent, or a ring. The compliant pad material and sliders could then be located within and around the areas bounded by the support foot.

Figure 6:
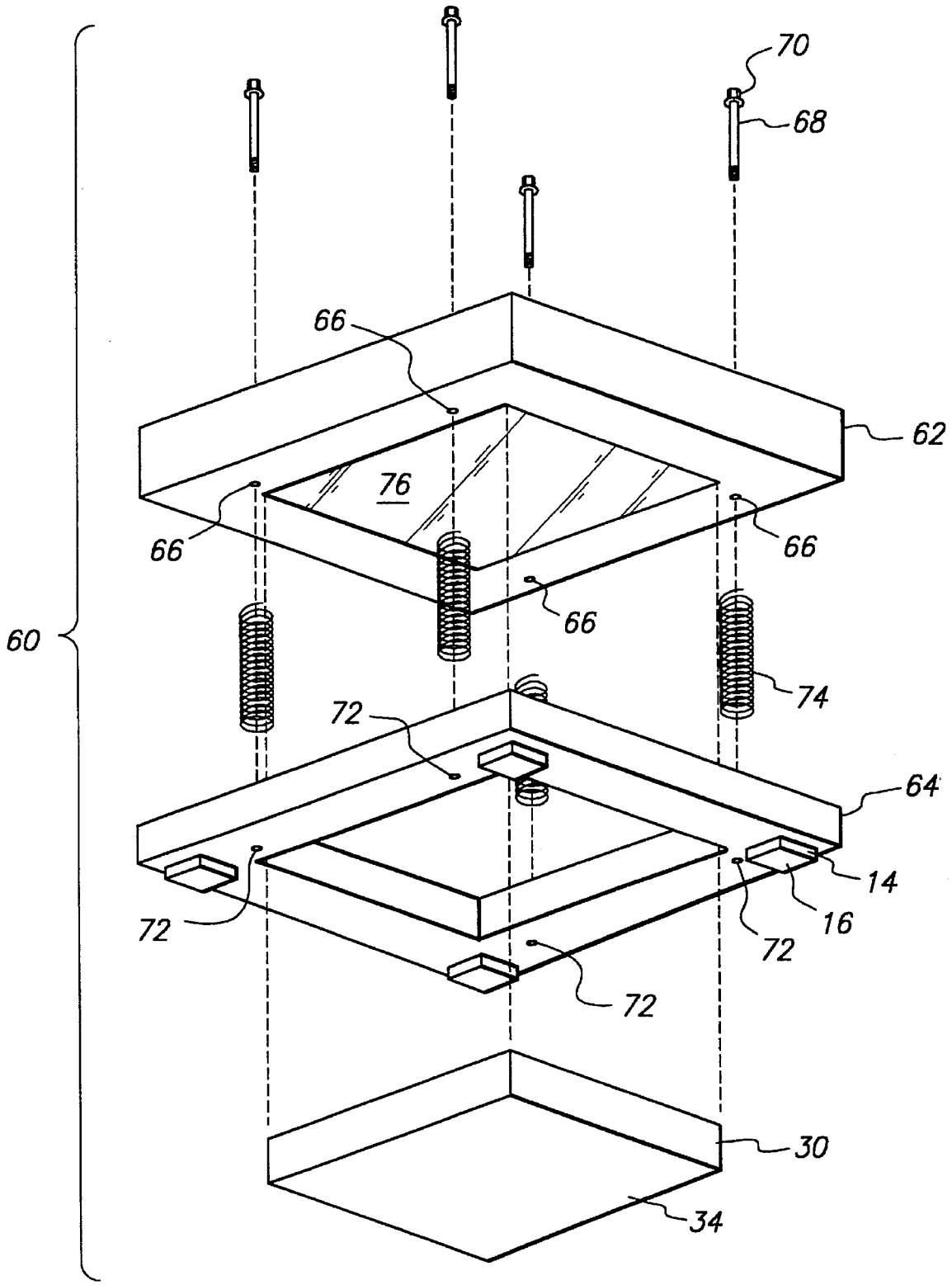
FIG. 6 shows an assembly drawing of a lapping fixture having a base, a frame, and a compliant pad.

FIG. 6 shows another embodiment of a lapping fixture 60. This lapping fixture 60 is assembled from a base 62, a frame 64, and a compliant pad 30. Four base holes 66 for accepting retaining screws 68 extend through the base 62. Other spacers, pistons, sliding rods, or the like may be used as retainers to join and position the plate 84 to the base 62. Similarly, a single ball-in-socket or other swivelling retainer may be used. As shown, the base holes 66 are untapped and large enough to allow threaded retaining screws 68 to slide easily into the base holes 66. Each retaining screw 68 has a head 70 which is larger than the diameter of the base holes 66 so that the head 70 interferes with the base 62. The frame 64 has four frame holes 72 corresponding to the base holes 66. The frame holes 72 are tapped to accept the threaded portion of the retaining screws 68. The frame 64 also has support feet 14 with positioning surfaces 16. The lapping fixture 60 is assembled as shown, with springs 74 around each retaining screw 68 positioned between the base 62 and the frame 64. The compliant pad 30 is attached to a contact area 76 on the base 62, with the frame 64 extending around the perimeter of the compliant pad 30.

Figure 7A:
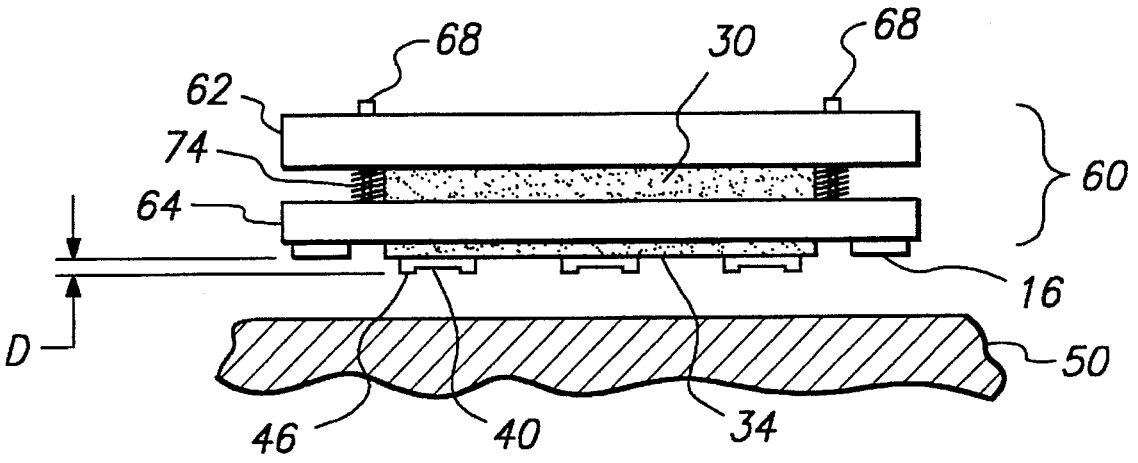
FIG. 7*a* shows an elevation view of the lapping fixture of FIG. 6 and magnetic recording head sliders positioned above a section of a lapping plate.

FIG. 7*a* shows the lapping fixture 60 positioned over the lapping plate 50. As in FIG. 5*a*, the air-bearing surfaces 46 of each slider 40 extend below the positioning surfaces 16 by an approximate distance 'D'. This distance is achieved by adjusting the retaining screws 68 until the plane defined by the positioning surfaces 16 is parallel to the contact surface 34 of the compliant pad 30. This adjustment of the frame 64 orientation allows the lapping fixture 60 to compensate for a variation in thickness of the compliant pad 30 across its contact surface 34.

Figure 7B:
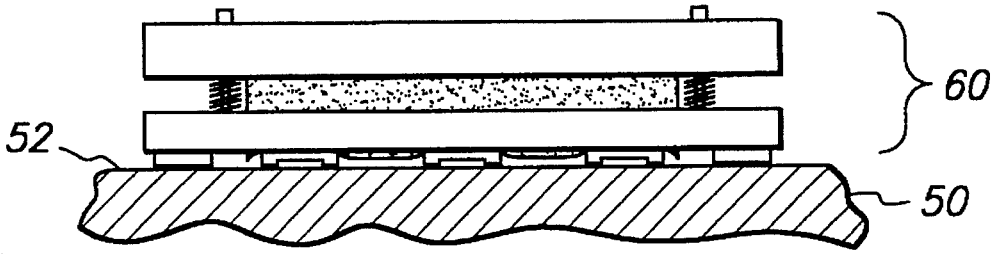
FIG. 7*b* shows an elevation view of the lapping fixture and magnetic recording head sliders positioned against the lapping plate of FIG. 7*a*.

FIG. 7*b* shows the lapping fixture 60 during the lapping process. As in FIG. 5*b*, the positioning surfaces 16 contact the lapping plate 50, causing the sliders 40 to be pressed into the compliant pad 30 by the lapping plate 50. The sliding motion of the lapping surface 52 across the air-bearing surfaces 46 cause the air-bearing surfaces 46 to be lapped, producing a uniform surface. As shown, the compressive force on the springs 74 is larger than the force applied by the lapping fixture 60 so that the springs 74 are not further compressed during the lapping operation.

Figure 8:
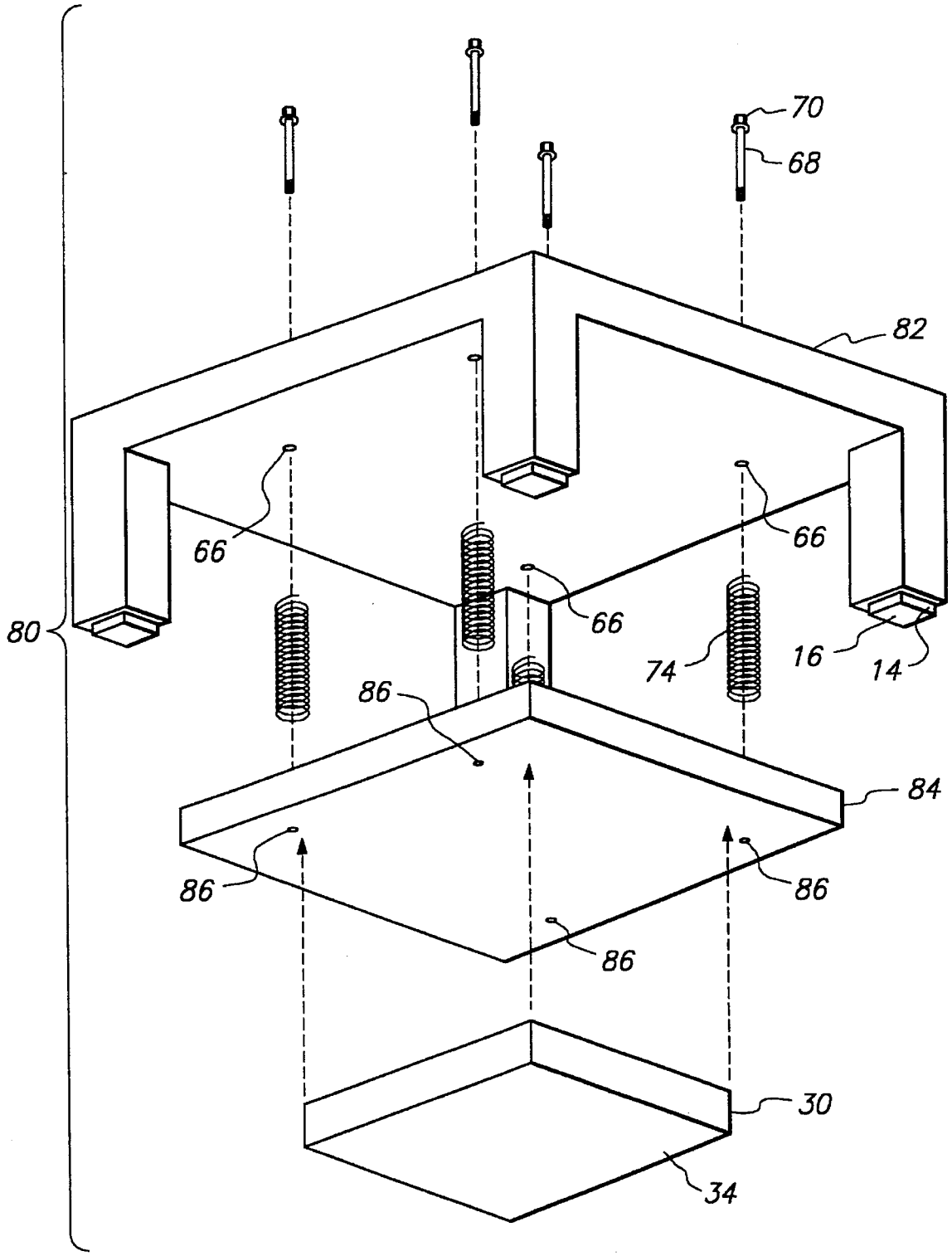
FIG. 8 shows an assembly drawing of a lapping fixture having a base, a plate, and a compliant pad.

FIG. 8 shows a further embodiment of a lapping fixture 80 which allows the orientation of the contact surface 34 of the compliant pad 30 to be adjusted relative to the positioning surfaces 16. The lapping fixture 80 is assembled from a base 82, a plate 84, and the compliant pad 30. Assembly is performed in the same manner as described in conjunction with FIG. 6. The retaining screws 68 are each inserted through a base hole 66, through a spring 74 and threaded into a corresponding plate hole 86.

Figure 9A:
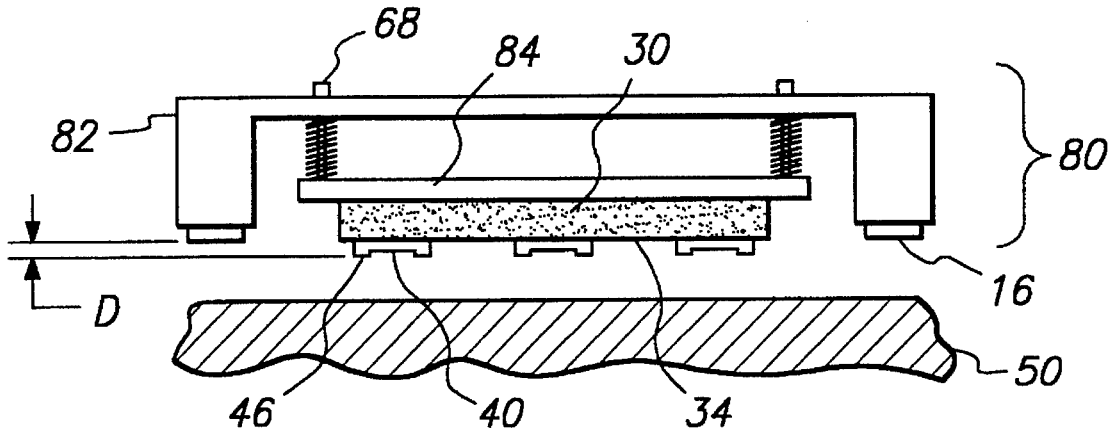
FIG. 9*a* shows an elevation view of the lapping fixture of FIG. 8 and magnetic recording head sliders positioned above a section of a lapping plate.
Figure 9B:
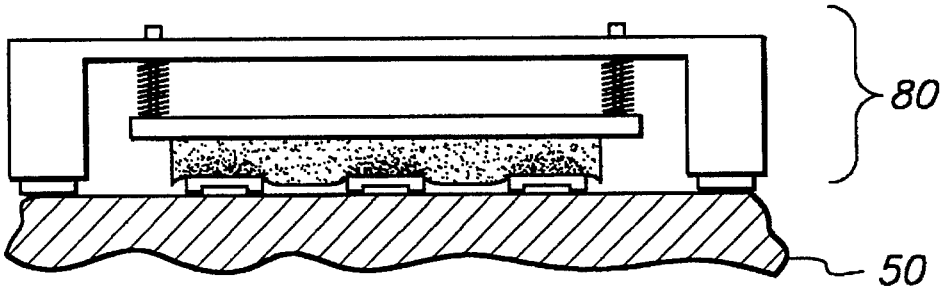
FIG. 9*b* shows an elevation view of the lapping fixture and magnetic recording head sliders positioned against the lapping plate of FIG. 9*a*.

FIG. 9*a* shows the lapping fixture 80 with the plate 84 adjusted by the retaining screws 68 such that the contact surface 34 of the compliant pad 30 is parallel with the plane defined by the positioning surfaces 16. As in FIGS. 5*a* and 7*a*, the air-bearing surfaces 46 of the sliders 40 in FIG. 9*a* extend beyond the positioning surfaces 16 by a distance 'D'. FIG. 9*b* shows the lapping fixture 80 during the lapping process. As in FIGS. 5*b* and 7*b*, the positioning surfaces 16 contact the lapping plate 50, causing the sliders 40 to be pressed into the compliant pad 30 by the lapping plate 50. As shown, the compressive force on the springs 74 is larger than the force applied by the lapping fixture 80 so that the springs 74 are not further compressed during the lapping operation.

Figure 10:
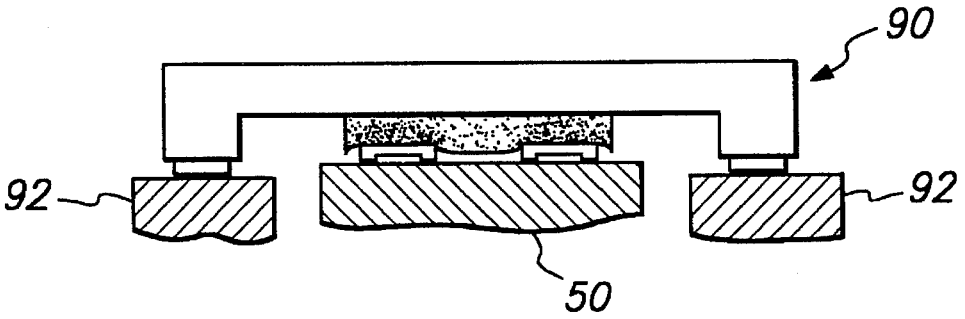
FIG. 10 shows an elevation view of a lapping fixture riding on sections of a reference surface, and magnetic recording head sliders being lapped on a section of a lapping plate.

FIG. 10 shows an embodiment of a lapping fixture 90 which rides on a reference surface 92. In the embodiments of FIGS. 1 through 9*b*, the lapping surface 52 served as the reference surface. FIG. 10, however, illustrates that a separate reference surface 92 may be provided.

As described, the lapping fixtures disclosed herein may be used to achieve a very smooth and uniform finish on the air-bearing surfaces 46 of sliders 40. The lapping fixtures provide independent movement of each slider 40 mounted on the compliant pad 30 and applies a uniform, controlled force to each slider 40 against the lapping surface 52. Because of this, recession errors may be corrected by lapping the air-bearing surfaces 46 of the sliders 40 with these lapping fixtures.

It will be clear that the lapping fixtures disclosed herein create air-bearing surfaces 46 whose contours are defined by the shape of the lapping surface 52. Thus, with the planar lapping surface 52 shown, planar air-bearing surfaces 46 are created. However, the disclosed lapping fixtures, when used with a lapping surface having curvature, will create air-bearing surfaces 46 having a corresponding curvature. For example, a concave lapping surface will create convex air-bearing surfaces.

The disclosed lapping fixtures may be used for the final finish lapping process, after the air-bearing surfaces have been lapped to the correct height in a previous process. In this case, the sliders may be lapped with the disclosed lapping fixtures for a predetermined length of time to smooth the air-bearing surfaces of the sliders, without removing enough slider material to substantially alter the slider dimensions. One such finish lapping process begins by placing the lapping fixture against the rotating lapping plate 50 and lapping the air-bearing surfaces 46 for approximately 15 seconds. The finish lapping process may then be completed by withdrawing the lapping fixture from contact with the lapping plate 50, rotating it 180 degrees, and replacing the lapping fixture against the lapping plate 50 for an additional 15 seconds. The duration of lapping may be varied inversely with the pressure applied to the air-bearing surfaces 46 of the sliders 50. This pressure will be determined by the durometer hardness of the compliant pad 30 and the displacement distance 'D', as described above, as well as by the total surface area of the air-bearing surfaces 46 being lapped.

The lapping fixtures may instead be used for the primary lapping process, which may eliminate the need for a separate finish lapping process. When used for the primary lapping process, the lapping fixtures may be used in conjunction with electronic or other lapping guides (not shown) to determine when the lapping process should halt.

The embodiments shown, when used with a planar lapping surface, produce planar air-bearing surfaces with a flatness controlled to within 0.2 μinches or less. When used with lapping surfaces having curvature, air-bearing surfaces are produced having a profile tolerance controlled to within 0.2 μinches or less.

In the embodiments shown, the lapping fixture is oriented such that the slider rails 42 are approximately perpendicular to the radius of the lapping plate 50. During each of the lapping operations described, the lapping fixture is moved back and forth along a line perpendicular to a radius of the lapping plate 50, and offset from the center of the lapping plate 50.

The disclosed lapping fixtures may be used to lap individual sliders or groups of sliders which have not yet been separated from each other. Where multiple sliders are still joined, forming bars, each bar of sliders is located on the compliant pad such that each bar may move somewhat independently of the other bars to find its own resting plane on the lapping plate. In one embodiment, the lapping fixtures are used to lap 30 to 35 individual sliders arranged in a rectangular grid on the compliant pad.

Illustrative specifications have been given for the compliant pad 30, but the particular dimensions, material and hardness of the compliant pad 30 are not critical individually. Instead, it is preferred that the compliant pad 30 allow each slider 40 (or bar of sliders) to move somewhat independently of other sliders (or bars of sliders) as they are pressed against the lapping plate 50, and that the compliant pad 30 apply a predetermined amount of normal force between each slider 40 (or bar of sliders) and the lapping surface 52. In addition, the thickness of the compliant pad 30 may be increased or decreased to allow correspondingly more or less deformation of the compliant pad 30.

While specific embodiments of the invention have been shown and described in detail to illustrate the application of the invention principles, it will be apparent that the invention may be embodied otherwise without deviating from the invention set forth in the following claims.

What is claimed is:

1. A fixture for holding disk sliders against a lapping surface comprising:

a base having a positioning surface for contacting a reference surface;

a compliant pad on the base having a contact surface facing outwardly from the base for carrying sliders, the compliant pad being dimensioned and positioned relative to the positioning surface effective to cause each slider to be in pressing contact relation with the lapping surface when the positioning surface is in contact with the reference surface; and wherein the base further comprises means for adjusting tile contact surface orientation, the means for adjusting the contact surface orientation being effective to orient the contact surface relative to the positioning surface of the base, the means for adjusting the contact surface orientation comprising:

a plate, the compliant pad being on the plate: and a retainer for coupling the plate to the base, the retainer being effective to maintain an adjustable orientation of the compliant pad relative to the positioning surface of the base.

2. The fixture of claim 1 further comprising a plurality of retainers in spaced apart relation.

3. The fixture of claim 1 further comprising means for attaching the sliders to the contact surface of the compliant pad effective to secure the position of the slider relative to the contact surface of the compliant pad.

4. The fixture of claim 1 wherein the compliant pad is a viscoelastic solid.

* * * * *